US009638212B2

(12) United States Patent
Marshall

(10) Patent No.: US 9,638,212 B2
(45) Date of Patent: May 2, 2017

(54) COMPRESSOR VARIABLE VANE ASSEMBLY

(71) Applicant: PRATT & WHITNEY CANADA CORP., Longueuil (CA)

(72) Inventor: Andrew R. Marshall, Grand Valley (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 615 days.

(21) Appl. No.: 14/133,873

(22) Filed: Dec. 19, 2013

(65) Prior Publication Data

US 2015/0176418 A1 Jun. 25, 2015

(51) Int. Cl.

| | |
|---|---|
| ***F01D 5/14*** | (2006.01) |
| ***F01D 9/04*** | (2006.01) |
| ***F01D 17/16*** | (2006.01) |
| ***F04D 29/54*** | (2006.01) |
| ***F04D 29/56*** | (2006.01) |
| ***F04D 29/68*** | (2006.01) |

(52) U.S. Cl.

CPC ..... *F04D 29/544* (2013.01); *F01D 9/04* (2013.01); *F01D 17/162* (2013.01); *F04D 29/545* (2013.01); *F04D 29/563* (2013.01); *F04D 29/681* (2013.01); *F01D 5/143* (2013.01); *F05D 2240/122* (2013.01); *F05D 2250/61* (2013.01)

(58) Field of Classification Search

CPC ..... F01D 5/143; F01D 17/16; F01D 17/162; F04D 29/545; F04D 29/547; F04D 29/56; F04D 29/563; F04D 29/566

See application file for complete search history.

(56) References Cited

U.S. PATENT DOCUMENTS

| | | | | |
|---|---|---|---|---|
| 2,650,752 A | | 9/1953 | Hoadley | |
| 2,735,612 A | | 2/1956 | Hausmann | |
| 4,195,964 A | * | 4/1980 | Kraft | F01D 17/162 29/889.21 |
| 4,278,398 A | | 7/1981 | Hull | |
| 4,706,354 A | * | 11/1987 | Naudet | F01D 17/162 29/428 |
| 6,602,049 B2 | | 8/2003 | Caubet et al. | |
| 6,969,232 B2 | | 11/2005 | Zess et al. | |

(Continued)

FOREIGN PATENT DOCUMENTS

GB 1505858 A * 3/1978 ..... F01D 17/162

*Primary Examiner* — Gregory Anderson
*Assistant Examiner* — Christopher R Legendre
(74) *Attorney, Agent, or Firm* — Norton Rose Fulbright Canada LLP

(57) ABSTRACT

A variable vane assembly for a gas turbine engine compressor with a plurality of pivoting variable vanes extending between inner and outer shrouds and having an overhang portion that protrudes from a button at opposed ends of the vane. A plurality of projections, disposed on at least one of the inner and outer shrouds, protrude into the gas path relative to a nominal gas path boundary of the shrouds. The projections are disposed adjacent the overhang portion and have an angled planar surface that is substantially parallel to a plane swept by a terminal edge of the overhang portion when the variable vane is rotated through its vane pivot arc, so that a radial clearance gap between the shroud and the overhang portion remains substantially constant through a substantial portion of the vane pivot arc.

18 Claims, 7 Drawing Sheets

(56) References Cited

U.S. PATENT DOCUMENTS

| | | | | |
|---|---|---|---|---|
| 7,371,046 | B2 | 5/2008 | Lee et al. | |
| 7,690,890 | B2 | 4/2010 | Aotsuka et al. | |
| 7,874,794 | B2 | 1/2011 | Solomon et al. | |
| 7,963,742 | B2 | 6/2011 | Clouse et al. | |
| 8,100,643 | B2 | 1/2012 | Leblanc et al. | |
| 8,105,019 | B2 | 1/2012 | McCaffrey et al. | |
| 8,105,037 | B2 | 1/2012 | Grover et al. | |
| 8,123,471 | B2 | 2/2012 | Mielke et al. | |
| 8,206,115 | B2 | 6/2012 | Gupta et al. | |
| 8,303,258 | B2 | 11/2012 | Aubin | |
| 9,353,643 | B2 * | 5/2016 | Major | F01D 17/162 |
| 2014/0140822 | A1 * | 5/2014 | Capozzi | F01D 9/00 415/160 |
| 2015/0176418 | A1 * | 6/2015 | Marshall | F04D 29/544 415/1 |
| 2015/0275916 | A1 * | 10/2015 | Marshall | F01D 17/162 415/148 |
| 2016/0237845 | A1 * | 8/2016 | Teixeira | F01D 5/143 |

* cited by examiner

COMPRESSOR VARIABLE VANE ASSEMBLY

TECHNICAL FIELD

The application relates generally to gas turbine engine compressors, and more particularly, to variable vanes for such compressors.

BACKGROUND

Variable vanes, namely vanes which are not fixed but pivot about axes such as to vary the angle of the vane airfoil, are sometimes used in gas turbine engine compressors to optimize compressor operability and/or efficiency over the compressor speed range. These variable vanes may include variable inlet guide vanes (IGV) located directly upstream of the first compressor stage, or variable vanes which form part of one or more of the subsequent downstream stages in a multistage compressor (ex: first compressor stage and/or second compressor stage, etc.). Variable vanes enable optimized compressor efficiency and/or operability by providing a close-coupled direction of the gas flow into the immediately downstream compressor rotor, and/or may introduce swirl into the compressor rotor to improve low speed operability of the compressor, and thus the engine, as well as to increase the flow capacity at high speeds.

Such variable vanes extend between the inner and outer shrouds which define the perimeter of the annular gas path into the compressor, and the variable vanes pivot about their respective radially extending axes to modify the angle of the vane airfoils and thus provide a closer incidence match between the air flow entering exiting the vane and the blade angle of the rotor. However, as each of the variable vane airfoils pivots about its radially extending axis, the clearance gap between the base and tip of the vane airfoil and the surrounding inner and outer shrouds, respectively, also varies. This can lead to greater vane tip losses which may negatively affect the aerodynamic performance of the vanes and thus the compressor. Improvements in variable compressor vanes are therefore sought.

SUMMARY

In one aspect, there is provided a variable vane assembly for a compressor of a gas turbine engine, the variable vane assembly comprising: an inner shroud and an outer shroud radially spaced apart from each other and defining therebetween an annular compressor gas path, the inner shroud and the outer shroud each having an annular boundary surface facing the gas path, the boundary surface defining a nominal gas path boundary; a plurality of variable vanes radially extending between the inner and outer shrouds, each of the variable vanes being pivotable through a vane pivot arc about a respective span-wise vane axis, the variable vanes having a button disposed on each of the radially inner and outer opposed ends, the buttons being respectively pivotably mounted in corresponding openings formed in the inner shroud and the outer shroud, the variable vanes having an airfoil extending between the buttons on said opposed ends and having a chord between a leading edge and a trailing edge, the airfoil having an overhang portion disposed at least said opposed ends and protruding beyond each of the buttons to overhang the shroud, and a radial clearance gap being defined between a terminal edge of the overhang portion and the respective inner and outer adjacent shrouds, the terminal edge of the overhang portion defining a plane when the variable vane is pivoted through said vane pivot arc; and wherein at least one of the inner and outer shrouds has a plurality of projections protruding into the gas path relative to said nominal gas path boundary, the projections disposed adjacent the overhang portion and having at least one angled planar surface that is substantially parallel to said plane, so that said radial clearance gap remains substantially constant through a substantial portion of said vane pivot arc.

In another aspect, there is provided a compressor for a gas turbine engine, the compressor comprising: an annular inner shroud and an annular outer shroud radially spaced apart and defining therebetween an annular compressor gas flow path; at least one rotor having an array of blades mounted on a rotatable shaft, the blades extending across the gas flow path; a plurality of circumferentially spaced apart variable vanes located upstream of the rotor and extending across the gas flow path from the inner shroud to the outer shroud, each of the variable vanes being rotatable through a range of rotation about a respective span-wise vane axis, each of the variable vanes defining an airfoil portion with leading and trailing edges, and opposed ends of the variable vane being pivotably mounted to the inner and outer shrouds, the airfoil portion defining a cord length between the leading edge and the trailing edge and having a downstream overhang portion at each of said opposed ends terminating at said trailing edge, a radial clearance gap being defined between a terminal edge of the overhang portion at each of said opposed ends and the respective inner and outer adjacent shrouds, the terminal edge of the overhang portion defining a plane when the variable vane is rotated through said range of rotation; and wherein a portion of the boundary surfaces of each of the inner and outer shrouds defines a nominal gas path boundary, and at least one of the inner and outer shrouds having an irregular surface profile thereon relative to the nominal gas path boundary, the irregular surface profile comprising a plurality of projections that protrude into the gas path relative to said nominal gas path boundary, said projections having at least one angled planar surface that is substantially parallel to said plane defined by the terminal edge of the overhang portion of said variable vane when pivoted through said vane pivot arc, the radial clearance gap between said angled planar surface and the terminal edge being substantially constant throughout said range of rotation of the variable vane.

In another aspect, there is provided a method of reducing compressor vane tip leakage losses in a variable vane assembly of a gas turbine engine compressor, the variable vane assembly having a plurality of pivoting variable vanes extending through a gas path defined between radially spaced apart inner and outer shrouds, the method comprising: minimizing a radial tip clearance gap between opposed ends of the variable vanes and the adjacent inner and outer shrouds by providing an irregular surface profile on a portion of a boundary surface of each of the inner and outer shrouds, the irregular surface profile including a plurality of projections that protrude into the gas path relative to a nominal gas path boundary of said boundary surface, and forming said projections having a gap-controlling surface thereon configured such that the radial clearance gap remains substantially constant throughout a pivoting travel of the variable vanes.

There is further provided a vane assembly for a gas turbine engine compressor with a plurality of variable vanes extending between inner and outer shrouds, which have an irregular surface profile on a portion of the boundary surfaces of at least one of the inner and outer shrouds. The irregular surface profile includes a plurality of projections that protrude into the gas path relative to a nominal gas path boundary of the shroud and which have a gap-controlling surface thereon configured such that the radial clearance gap between the ends of the variable vanes remains substantially constant throughout an arc of travel of the pivoting variable vanes.

BRIEF DESCRIPTION OF THE DRAWINGS

Reference is now made to the accompanying figures in which.

DETAILED DESCRIPTION

Figure 1:
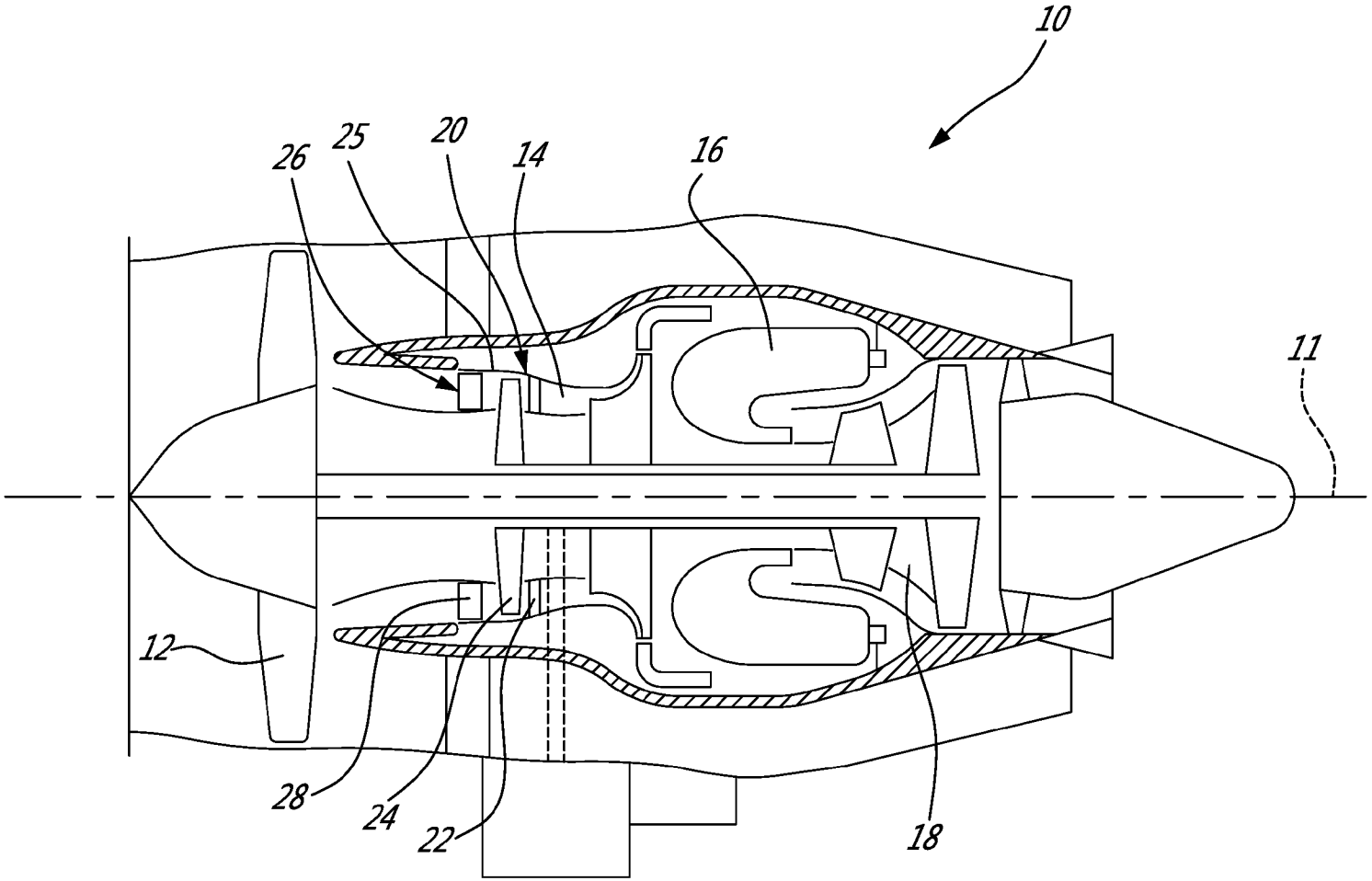
FIG. 1 is a schematic cross-sectional view of a gas turbine engine.

FIG. 1 illustrates a gas turbine engine 10 of a type preferably provided for use in subsonic flight, generally comprising in serial flow communication a fan 12 through which ambient air is propelled, a multistage compressor 14 for pressurizing the air, a combustor 16 in which the compressed air is mixed with fuel and ignited for generating an annular stream of hot combustion gases, and a turbine section 18 for extracting energy from the combustion gases. The compressor 14 and turbine 16 are mounted on main engine shafts which rotate about a common longitudinal axis 11 of the engine. The multistage compressor section 14 includes at least a first stage, low pressure, axial compressor 20 located downstream of the fan 12. The compressor 14 of the gas turbine engine 10 may be a multi-stage compressor, and thus may comprise several axial and/or centrifugal compressors. Although a turbofan engine is depicted and described herein, it will be understood however that the gas turbine engine 10 may comprise other types of gas turbine engines such as a turbo-shaft, a turbo-prop, or auxiliary power units, and that the axial compressor 20 may form part of the compressor section of any of these types of gas turbine engines.

The first stage axial compressor 20 of the compressor section 14 comprises generally a rotor 24 and a stator 22 downstream of the rotor, each having a plurality of airfoils blades radially extending through the annular compressor gas path defined by the compressor gas flow passage 25. The compressor gas flow passage 25 may include a stationary and circumferentially extending outer shroud which defines a radial outer boundary of the annular gas flow path through the compressor 20, and an inner hub or shroud which is radially inwardly spaced from outer shroud and defines a radial inner boundary of the annular gas flow path through the compressor 20.

The compressor 14 may, in one possible embodiment, include an inlet guide vane assembly 26 located within the compressor inlet upstream of the rotor 24 of the first stage 20 of the compressor. Alternately, however, the compressor 14 may not comprise any IGVs, and instead include only several compressor stages, each comprising a rotor and a downstream vane assembly. The IGV assembly may be a variable vane assembly 26, as will be described in further detail below. Instead of, or in addition to, the variable IGV, the stator 22 of the first compressor stage 20 and/or any stator vane of any of the plurality of stages of the multistage compressor 20, may alternately comprise a variable vane assembly as described herein. Accordingly, it is to be understood that the variable vane assembly 26 as described herein may be an IGV assembly, and/or may be a vane assembly forming any one or more of the compressor stages. Regardless, the variable vane assembly 26 as described herein comprises a plurality of variable vane airfoils 28 which radially project through the compressor gas flow passage 25 and are operable to pivot about their respective radially extending axes such as to modify and thus control the angle of the vane airfoils 28.

Figure 2:
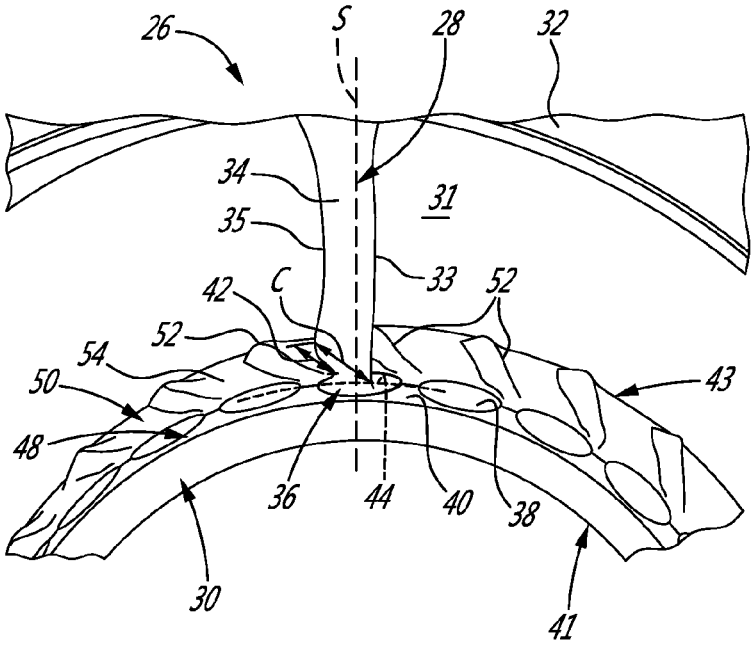
FIG. 2 is a partial front perspective view of a variable vane assembly of the gas turbine engine of FIG. 1, showing a single variable vane in a first position.
Figure 5:
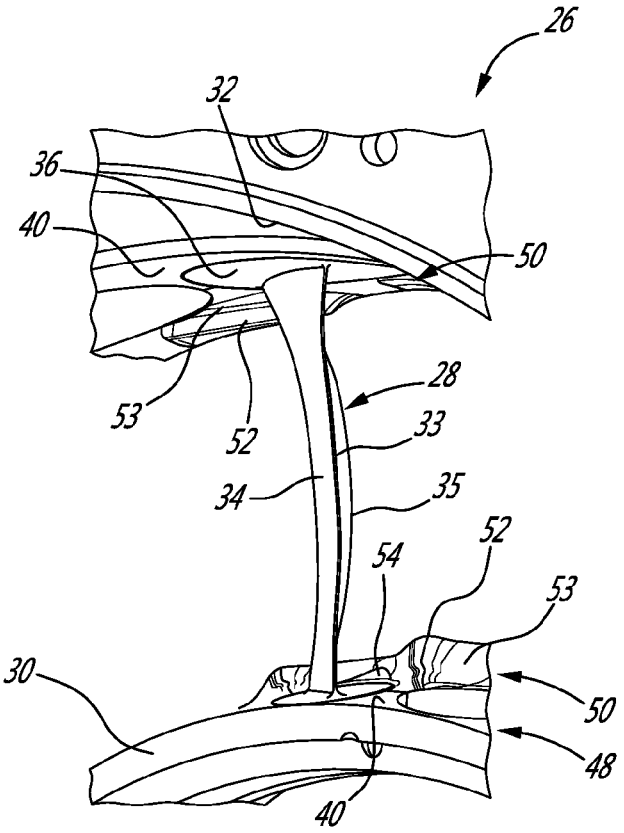
FIG. 5 is a partial front perspective view of the variable vane of FIG. 2, looking downstream into the compressor, showing both the inner and outer shrouds.
Figure 6:
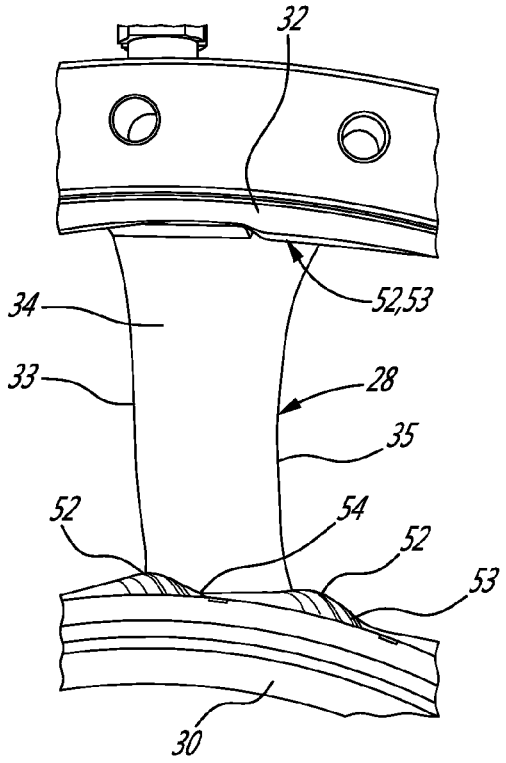
FIG. 6 is a partial rear perspective view of the variable vane of FIG. 2, looking upstream, showing both the inner and outer shrouds.
Figure 7:
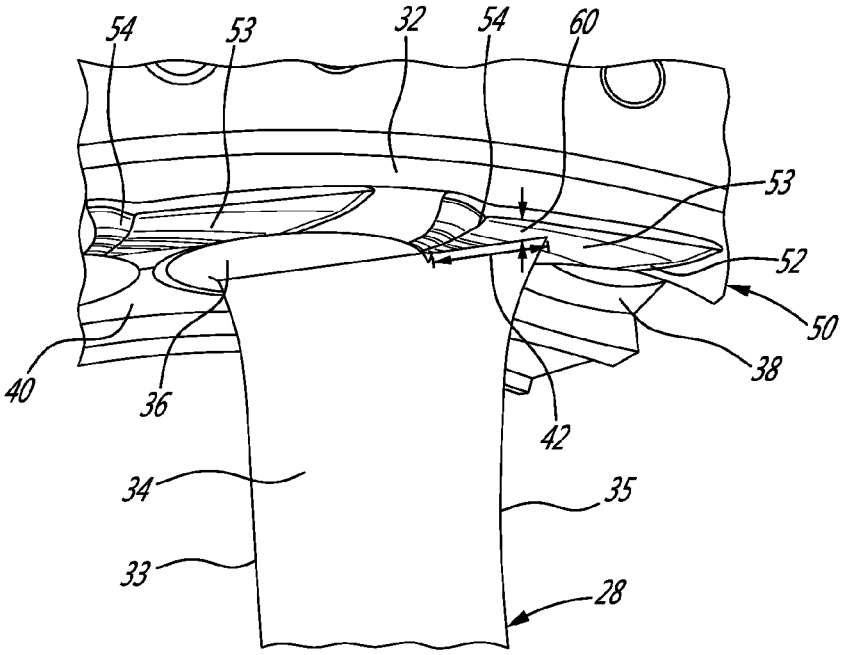
FIG. 7 is a partial detailed rear perspective view of the variable vane of FIG. 2, showing the radially outer end of a variable vane and the outer shroud.
Figure 8:
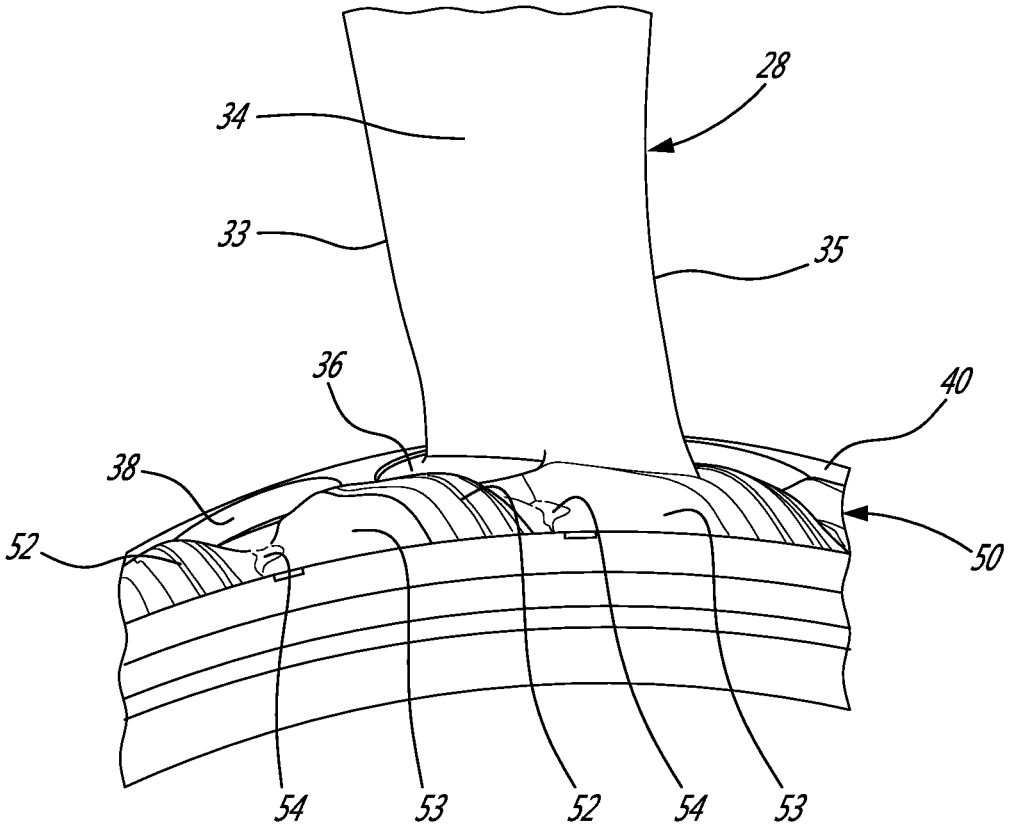
FIG. 8 is a partial detailed rear perspective view of the variable vane of FIG. 2, showing the radially inner end of a variable vane and the inner shroud.

Referring now to FIGS. 2 and 5, the variable vane assembly 26 includes generally a radially inner shroud 30, a radially outer shroud 32, and a plurality of variable vanes 28 (only one of which is shown, for ease of explanation), each of which is pivotable about its respective span-wise pivot axis S. In at least one particular embodiment, these span-wise pivot axes S of the variable vanes 28 may be substantially radially extending. The variable vanes 28 are circumferentially spaced apart about the variable vane assembly 26, and radially extend between the inner and outer shrouds 30 and 32. Each of the variable vanes 28 includes a central airfoil portion 34 and buttons 36 disposed on each of the radially inner and outer ends of the variable vane 28. The radially inner and outer buttons 36 (only the inner button is visible in FIG. 2) may be integrally formed with the airfoil portion 34 of the variable vane 28, and are substantially circularly shaped radial protrusions at each of the opposed ends of the variable vanes 28.

The buttons 36 are received within correspondingly shaped openings 38 formed the inner and outer shrouds 30, 32. Accordingly, rotation of one or both of the buttons 36 within the inner and outer shrouds 30, 32 causes corresponding rotation of the airfoil portion 34 of the variable vane 28 about its span-wise axis S. This therefore permits the angle of the variable vane 28 to be varied as required. The buttons 36 may, in one particular embodiment, be mounted on integrally formed trunions (not shown) which extend for example through the shrouds. Each of the variable vanes 28 is actuated for pivoting about its respective span-wise axis S using an appropriate type of actuation mechanism, for example a gear arrangement, a lever assembly, a pneumatic or hydraulic system, etc. This actuation mechanism is in communication with, and operated by, a control system which is operable to vary the angle of the vanes 28 as desired.

The leading edge 33 of each airfoil 34 of the variable vanes 28 is substantially axially aligned with the buttons 36, which are disposed at the forward or upstream end of the vanes 28, such that the leading edge 33 of the vane airfoil 34 intersects the button 36 at a point at or within the outer periphery of the circular button 36. Because the cord-wise length C of the vane airfoil 34 at the radial ends thereof is greater than the diameter of the button 36, a downstream overhang portion 42 of the vane airfoil 34 projects beyond the perimeter of the button 36 toward a trailing edge 35 of the vane airfoil 34.

In traditional variable vane assembly designs, as the vane pivots about its own radial axis, a gap between the ends (radially inner and outer) of the vane airfoil and the adjacent annular gas path passage wall also varies. The size of this mainly radial gap will depend on the radius of the annular gas path passage wall and the angle at which the variable vane is positioned relative to this wall surface.

Accordingly, referring now to FIGS. 2-8, one or both of the radially inner shroud 30 and the radially outer shroud 32 of the present variable vane assembly 26 includes a non-smooth surface treatment, as will now be described in more detail, on at least a downstream portion 50 of the shroud in order to reduce this radial vane clearance gap 60 and thus limit gas loss therethrough.

Figure 3:
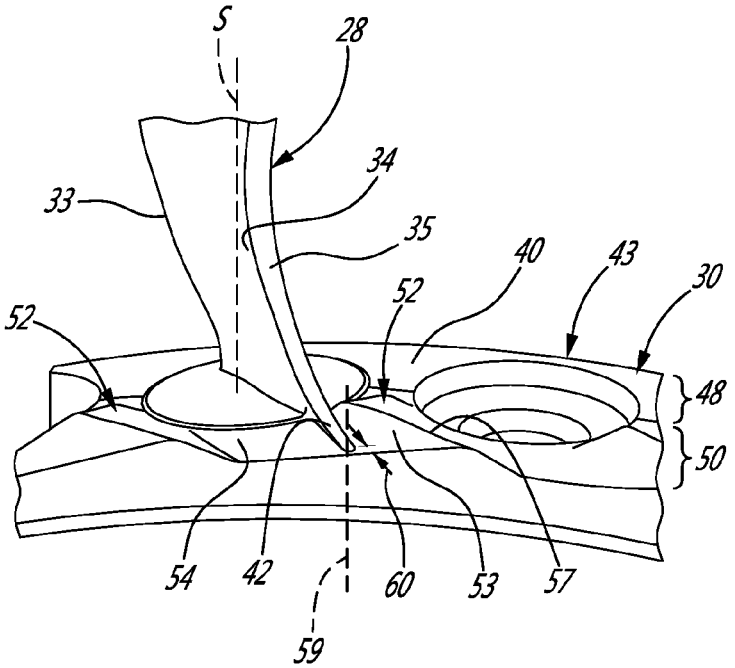
FIG. 3 is a detailed partial rear perspective view of the variable vane of FIG. 2, showing a radially inner end of the variable vane in the first position relative to the inner shroud.
Figure 4:
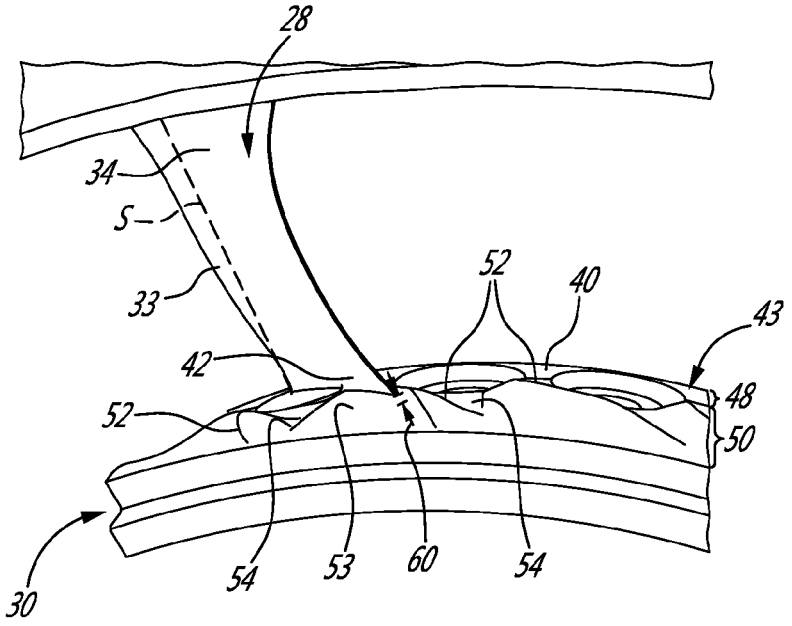
FIG. 4 is detailed partial rear perspective view of the variable vane assembly of FIG. 2, showing the single variable vane in a second position.

For simplicity of explanation, the inner shroud 30 of the variable vane assembly 26, as shown in FIGS. 2-4, will be described in further detail below. However, it is to be understood that the features and details of the outer shroud 32 are similar, and that those features described below which are also found on the outer shroud 32 correspond and operate in a similar manner (albeit inverted such as to face the annular gas path 31).

The inner shroud 30 of the variable vane assembly 26 includes a radially outer surface 41 facing away from the gas path 31 defined between the inner and outer shrouds 30, 32, and a radially inner surface 43 facing towards the annular gas path 31. The radially inner surface 43 of the inner shroud 30 includes an upstream portion 48 and a downstream portion 50. The downstream portion 50 may be disposed at least downstream of the openings 38 in the shroud 30 which receive the vane buttons 36 therein. In at least one embodiment, the downstream portion 50 is defined as being disposed rearward (i.e. downstream) of an annularly extending axis 44 which is axially aligned approximately with a midpoint of the circular openings 38 and therefore with a center of rotation of the variable inlet guide vanes.

At least the downstream portion 50 of the radially inner surface 43 of the inner shroud 30 has an irregular surface profile relative to a nominal gas path boundary surface. This nominal gas path boundary surface of the inner shroud may, for example, may be defined by the smooth surface 40 disposed on the upstream portion 48 of the inner shroud 30 and facing the gas path 31. The irregular surface profile of the downstream portion 50 comprises, in the depicted embodiment, a plurality of projections 52 which protrude into the gas path 31 relative to the smooth and flat surface 40 of the upstream portion 48 of the shroud 30. The projections 52 may also be optimized such as to limit aerodynamic losses, and thus may be formed as flow optimization surfaces. As seen in FIG. 2, one of these projections 52 is disposed between each of the plurality of variable vanes 28. These projections 52 also act as gap-controlling elements as they maintain a substantially constant clearance gap between a radially inner end of the vane airfoil 34 and the inner shroud 30.

Accordingly, the plurality of projections 52, which at least partially form the irregular surface profile of the downstream portion 50 of the inner shroud 30, are circumferentially spaced apart about the full circumference of the inner shroud 30, and are circumferentially offset from the vanes 28 such that at least one of the projections 52 is disposed between each pair of vanes 28. The irregular surface profile of the downstream portion 50 may also comprise recesses 54, rather than or in addition to the projections 52, which project (in the case of the inner shroud 30) radially inwardly into the material of the inner shroud 30 and thus which define troughs or grooves in the shroud 30 that extend below the nominal gas path surface of the shroud, as defined for example by the inwardly facing smooth surface 40 of the upstream portion 48.

The exact shape and configuration of the projections 52 which form the irregular surface profile of the downstream portion 50 of the inner shroud 30 is selected such as to minimize the radial clearance gap 60 defined between the radial edge of the overhang portion 42 of the vane airfoil 34 and the shroud 30, and to maintain this clearance gap 60 substantially constant throughout the range of travel of the pivoting variable vane 28.

As best seen in FIGS. 3 and 4, this may be achieved, for example, by providing the irregular surface profile of the inner shroud 30 with angled and/or tapered "ramp" surface portions 53 which define gap-controlling surfaces that extend between the recesses 54 and the projections 52 in the downstream portion 50. The projections 52 may therefore have a tapered shape, and include a ridge 57 extending at an angle relative to a longitudinal axis 59 (parallel to the longitudinal main engine axis 11) and at least one angled planar surface 53 terminating the ridge 57 and defining the gap-controlling surface. The slope of the angled planar surface 53 may, in at least one embodiment, be substantially constant along the length of the surface from a base (or planar region 54) to the ridge 57 of the projection 52. Additionally, as best seen in FIG. 3, in at least one embodiment, the tapered projections 52 are asymmetrical relative to the longitudinal axis 59, wherein the slope of the angled planar surface 53 is different from that of the angled surface on the opposite side of the ridge 57. The circumferential location and radial height of the projections 52 and the slope of the tapered/angled surfaces 53 are selected such that as the airfoil 34 of the variable vane 28 pivots about its radial span-wise axis (and the airfoil overhang 42 swings between the extreme ends of the pivoting travel of the variable vane), the radial clearance gap 60 (defined between the radially edge of the airfoil overhang 42 and the surface of the shroud 30) is maintained substantially constant through the full arc of travel of the pivoting vane 28. The slope of the tapered/angled surfaces 53 therefore is selected in consequence of, and is dependent on, the diameter of the annular shrouds, given that without such projections 52, the radial clearance gap 60 would be greater as the vane pivots further away from its centerline position, due to the curvature of the annular shrouds. As such, the projections 52 and tapered surfaces 53 of the irregular surface profile on the downstream portions of the shrouds maintains a substantially constant clearance gap 60 throughout travel of the variable vane, thereby enabling the leakage airflow through this clearance gap 60 to be minimized and accordingly reducing losses due to turbulence induced by flow between the vane blades 28 and the shrouds 30, 32 defining the gas path 31. This reduction in losses due to turbulence induced flow may result, consequently, in improved compressor operability over the complete range of motion of the variable IGVs 28.

Figure 9A:
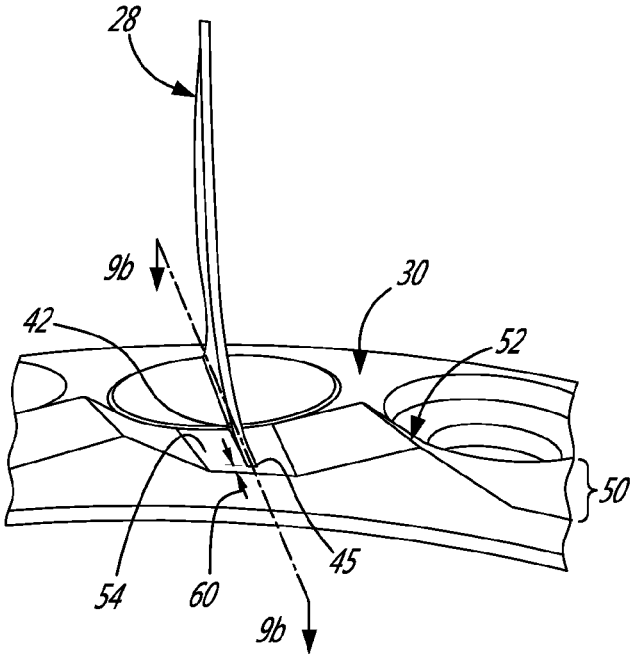
FIG. 9*a* is a partial rear perspective view of the variable vane of FIG. 2, showing the variable vane in a first, fore-aft centerline, position.
Figure 9B:
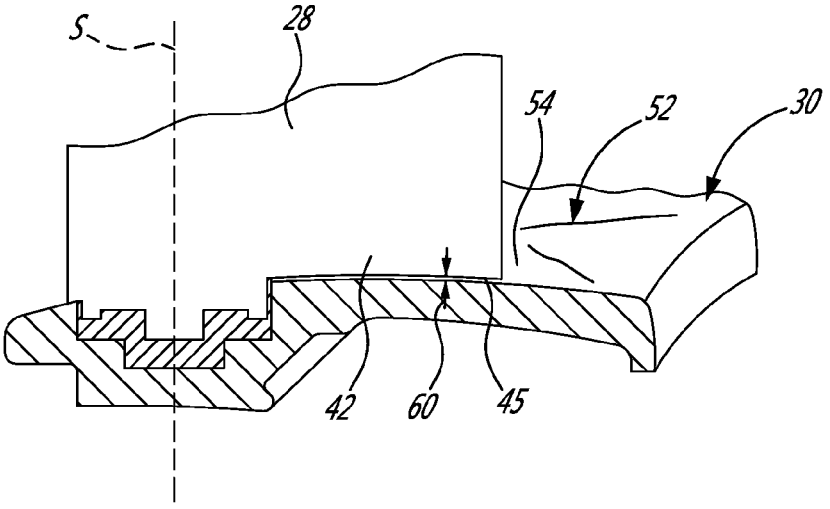
FIG. 9*b* is a cross-sectional view taken through the line 9*b*-9*b* of FIG. 9*a;*
Figure 10A:
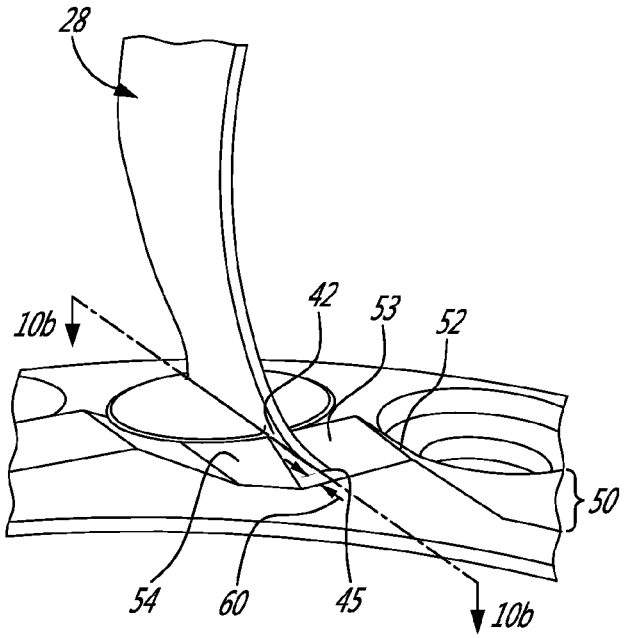
FIG. 10*a* is a partial rear perspective view of the variable vane of FIG. 2, showing the variable vane in a second, angled, position wherein the vane airfoil has been pivoted about its span-wise axis.
Figure 10B:
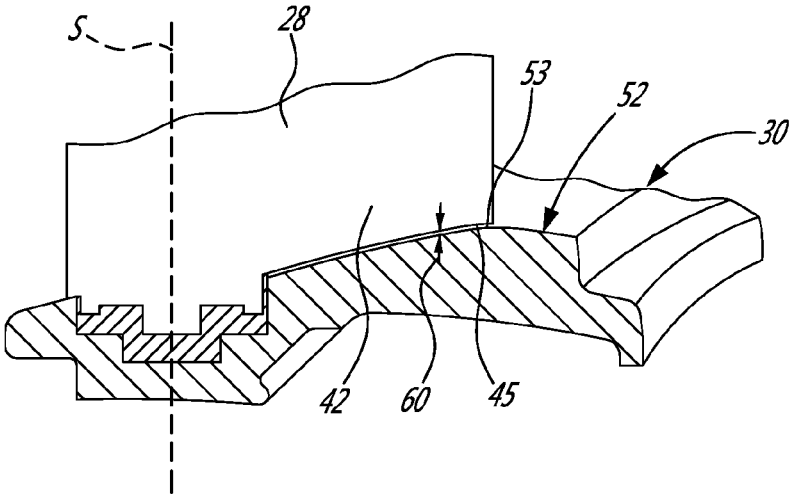
FIG. 10*b* is a cross-sectional view taken through the line 10*b*-10*b* of FIG. 10*a*.

As more clearly shown in FIGS. 9*a*-10*b*, the radial clearance gap 60, defined between the terminal edge 45 of the airfoil overhang 42 and the surface of the shroud 30, is maintained substantially constant through the full arc of travel of the pivoting vane 28. As can be seen in FIGS. 9*a*-9*b*, wherein the vane is located in a substantially fore-aft centerline position, the radial clearance gap 60 is defined between the terminal edge 45 of the downstream vane airfoil overhang 42 and the adjacent planar base surface 54 of the shroud 30 which defines the nominal gas path surface. When the variable vane 28 is pivoted about its own span-wise pivot axis S into an angled vane position, such as that shown in FIGS. 10*a*-10*b*, the size of the radial clearance gap 60, now defined between the edge 45 of the downstream vane airfoil overhang 42 and the tapered/angled surface 53 of the projection 52 formed on the downstream portion 50 of the shroud 30, remains substantially the same as the gap when the vane was oriented in its centerline position (FIGS. 9*a*-9*b*).

While the addition of the flow optimization surfaces forming the irregular surface profile provided within the downstream portion 50 of the shroud 30, and more particularly the projections 52 which extend into the flow stream of the gas path 31, enables the vane tip clearance gap 60 to be minimized and maintained substantially uniform over the full range of pivoting travel of the variable vanes 28, these projections may potentially cause flow disturbances which should be minimized. This may be achieved, for example, by balancing the projections 52 with neutralizing recesses 54, and alternately by extending portions of the irregular surface profile (ex: the projections 52, angular surfaces 53, recesses 54, etc.) upstream of the axis 44 (see FIG. 2) and the leading edge 33 of the vane airfoil 34, and thus into the upstream portion 48 of the outer surface 43 of the shroud 30. The specific profile of these projections 52 etc. of the irregular surface profile are selected after running computational fluid dynamics CFD models in order to optimize the fluid flow through the irregular surface profile portion of the shroud 30, and thus limit flow disturbances in the gas path 31 leading to the compressor rotors 24 and other downstream components.

In at least the depicted embodiment, the projections 52, recesses 54 and angular surface portions 53 of the irregular surface profile of the downstream portion 50 are integrally formed with the remainder of the inner shroud 30. The irregular surface profile may thus be created within the outer surface 43 of the shroud using an appropriate machining process, such as milling for example.

Although the inner shroud 30 of the present variable vane assembly 26 is described in detail above with respect to the irregular surface profile on at least a downstream portion 50 thereof, which reduces the radial vane clearance gap 60 throughout the entire range of travel of the pivoting variable vanes 28, the outer shroud 32 of the variable vane assembly 26 may be similarly configured. More particularly, as best seen in FIGS. 5-8, the outer shroud 32 similarly comprises flow optimization surfaces which form the irregular surface profile on the downstream portion 50 of the outer shroud 32. The flow optimization surfaces of the irregular surface profile similarly comprise projections 52, recesses 54 and/or angular surface portions, at least the projections 52 and angular surfaces 53 of which protrude into the gas path relative to the smooth upstream portion 40 of the outer shroud 32. The projections 52 of the downstream irregular surface profile are similarly disposed between each of the variable vanes 28 on the outer shroud. Thus, the flow optimization surfaces also define gap-controlling elements at the outer radial ends of the variable vanes 28, such as to maintain a substantially constant gap clearance between a radially outer end of the vane airfoil 34 and the outer shroud 32.

While both the inner and outer shrouds 30, 32 are described above and depicted in the enclosed drawings as comprising the flow optimizing irregular surface profiles, in an alternate embodiment one of the inner shroud 30 and the outer shroud 32 may be provided with an inwardly facing shroud surface, facing the gas path 31, which has an irregular surface profile as described herein on at least the downstream portion thereof.

The above description is meant to be exemplary only, and one skilled in the art will recognize that changes may be made to the embodiments described without departing from the scope of the invention disclosed. Modifications which fall within the scope of the present invention will be apparent to those skilled in the art, in light of a review of this disclosure, and such modifications are intended to fall within the appended claims.

The invention claimed is:

1. A variable vane assembly for a compressor of a gas turbine engine, the variable vane assembly comprising:

an inner shroud and an outer shroud radially spaced apart from each other and defining therebetween an annular compressor gas path, the inner shroud and the outer shroud each having an annular boundary surface facing the gas path, each boundary surface defining a nominal gas path boundary;

a plurality of variable vanes radially extending between the inner and outer shrouds, each of the variable vanes being pivotable through a vane pivot arc about a span-wise vane axis, each variable vane having: a button disposed on each of radially inner and outer opposed ends, the buttons being respectively pivotably mounted in corresponding openings formed in the inner shroud and the outer shroud, an airfoil extending between the buttons on said opposed ends and having a chord between a leading edge and a trailing edge, the airfoil having an overhang portion disposed at said radially inner and outer opposed ends and protruding beyond each of the buttons to form an overhang portion, and radial clearance gaps being defined between terminal edges of the overhang portion and the inner and outer adjacent shroud, respectively, each of the terminal edges of the overhang portion defining a plane swept by the terminal edge when the variable vane is pivoted through said vane pivot arc; and wherein at least one of the inner and outer shrouds has a plurality of projections protruding into the gas path relative to the nominal gas path boundary thereof, each projection disposed adjacent each overhang portion and comprising: at least one angled planar surface including a ramp surface that is substantially parallel to said plane of the adjacent overhang portion and delimits the corresponding radial clearance gap, which remains substantially constant through at least a substantial portion of said corresponding vane pivot arc;

wherein the projections form an irregular surface profile which further comprises one or more recesses in the at least one of the inner and outer shrouds relative to the corresponding nominal gas path boundary, said recesses being configured to minimize flow disturbances in an air flow through the gas path.

2. The variable vane assembly as defined in claim 1, wherein said plurality of projections are circumferentially spaced apart, with each projection being disposed between each of the variable vanes.

3. The variable vane assembly as defined in claim 1, wherein the boundary surface of the inner and outer shrouds includes an upstream portion and a downstream portion, said projections being disposed on the downstream portion of the inner and outer shrouds.

4. The variable vane assembly as defined in claim 3, wherein the projections extend into the upstream portion of the boundary surface of said inner and outer shrouds.

5. The variable vane assembly as defined in claim 3, wherein the upstream portion and the downstream portion of the boundary surface on the inner and outer shrouds are delineated, respectively, by an annularly extending axis that is axially aligned with a center of rotation of each of the variable vanes.

6. The variable vane assembly as defined in claim 1, wherein the projections are disposed on both the inner and the outer shrouds.

7. The variable vane assembly as defined in claim 1, wherein a portion of the boundary surfaces defines the nominal gas path boundary, respectively, and is substantially smooth.

8. The variable vane assembly as defined in claim 1, wherein each projection has a tapered shape comprising: a ridge extending at an angle relative to the corresponding span-wise vane axis, said at least one planar surface terminating at said ridge.

9. The variable vane assembly as defined in claim 8, wherein each projection is asymmetrical relative to a longitudinal axis thereof.

10. The variable vane assembly as defined in claim 1, wherein the at least one angled planar surface on each projection has a substantially constant slope.

11. The variable vane assembly as defined in claim 1, wherein the variable vanes are variable inlet guide vanes of the compressor.

12. A compressor for a gas turbine engine, the compressor comprising:

an inner shroud and an annular outer shroud radially spaced apart and defining therebetween an annular compressor gas flow path;

at least one rotor having an array of blades mounted on a rotatable shaft, the blades extending across the gas flow path; and a plurality of circumferentially spaced apart variable vanes located upstream of the at least one rotor and extending across the gas flow path from the inner shroud to the outer shroud, each of the variable vanes being rotatable through a range of rotation about a span-wise vane axis, each of the variable vanes having: an airfoil portion with leading and trailing edges, opposed ends pivotably mounted to the inner and outer shrouds, the airfoil portion defining a chord length between the leading edge and the trailing edge and having an overhang portion at each of said opposed ends terminating at said trailing edge, radial clearance gaps being defined between terminal edges of the overhang portion and the inner and outer shrouds, respectively, each of the terminal edges of the overhang portion defining a plane when the variable vane is rotated through said range of rotation; and wherein a portion of boundary surfaces of each of the inner and outer shrouds defines a nominal gas path boundary, and at least one of the inner and outer shrouds having an irregular surface profile thereon relative to the respective nominal gas path boundary, each irregular surface profile comprising a plurality of projections that protrude into the gas path relative to said nominal gas path boundary, respectively, each projection being opposed from a corresponding one of the variable vanes and comprising: at least one angled planar surface having a ramp surface that is substantially parallel to said plane defined by the terminal edge of the overhang portion of the corresponding variable vane when pivoted through its range of rotation, the radial clearance gap between the ramp surface and the terminal edge being substantially constant through said range of rotation of the corresponding variable vane, and each projection having a tapered shape comprising: a ridge extending at an angle relative to the span-wise vane axis of the corresponding vane, said at least one angled planar surface terminating at said ridge.

13. The compressor as defined in claim 12, wherein the compressor includes an annular inlet duct at least partially defined by the inner and outer shrouds and the variable vanes are variable inlet guide vanes of the compressor.

14. The compressor as defined in claim 12, wherein each irregular surface profile comprises: one or more recesses in the respective shroud relative to the nominal gas path boundary, said one or more recesses being configured to minimize flow disturbances in the air flow through the gas path.

15. The compressor as defined in claim 12, wherein said plurality of projections are circumferentially spaced apart, with each projection being disposed between each of the variable vanes.

16. The compressor as defined in claim 12, wherein each inner and outer shroud comprises: an upstream portion and a downstream portion of the boundary surface delineated by an annularly extending axis that is axially aligned with a center of rotation of each of the variable vanes, wherein the upstream portion defines the nominal gas path boundary and the downstream portion defines the irregular surface profile.

17. The compressor as defined in claim 12, wherein said portion of the boundary surfaces that defines each nominal gas path boundary is substantially smooth.

18. A method of reducing compressor vane tip leakage losses in a variable vane assembly of a gas turbine engine compressor, the variable vane assembly having a plurality of pivoting variable vanes extending through a gas path defined between radially spaced apart inner and outer shrouds, the method comprising: minimizing a radial tip clearance gap between opposed ends of the variable vanes and the adjacent inner and outer shrouds, respectively, by providing an irregular surface profile on a portion of a boundary surface of each of the inner and outer shrouds, each irregular surface profile including a plurality of projections that protrude into the gas path relative to a nominal gas path boundary of each boundary surface; and forming said projections to have a gap-controlling surface thereon configured such that each radial clearance gap remains constant throughout pivoting travel of the variable vanes.

* * * * *